US006866690B2

(12) United States Patent
Aradi et al.

(10) Patent No.: US 6,866,690 B2
(45) Date of Patent: Mar. 15, 2005

(54) FRICTION MODIFIER ADDITIVES FOR FUEL COMPOSITIONS AND METHODS OF USE THEREOF

(75) Inventors: Allen A. Aradi, Richmond, VA (US); Dennis J. Malfer, Glen Allen, VA (US); Scott D. Schwab, Richmond, VA (US)

(73) Assignee: Ethyl Corporation, Richmond, VA (US)

( * ) Notice: Subject to any disclaimer, the term of this patent is extended or adjusted under 35 U.S.C. 154(b) by 94 days.

(21) Appl. No.: 10/128,529

(22) Filed: Apr. 24, 2002

(65) Prior Publication Data

US 2003/0200697 A1 Oct. 30, 2003

(51) Int. Cl.[7] ..... C10L 1/22
(52) U.S. Cl. ..... 44/408
(58) Field of Search ..... 44/408; 564/1; 554/1

(56) References Cited

U.S. PATENT DOCUMENTS

| | | | | |
|---|---|---|---|---|
| 3,893,825 | A | * 7/1975 | Goeller | 44/408 |
| 3,996,024 | A | * 12/1976 | Coon et al. | 44/409 |
| 4,086,172 | A | 4/1978 | Lowe | |
| 4,129,508 | A | 12/1978 | Friihauf | |
| 4,185,594 | A | 1/1980 | Perilstein | |
| 4,204,481 | A | 5/1980 | Malec | |
| 4,208,190 | A | 6/1980 | Malec | |
| 4,231,883 | A | 11/1980 | Malec | |
| 4,280,916 | A | 7/1981 | Richards et al. | |
| 4,406,803 | A | 9/1983 | Liston et al. | |
| 4,409,000 | A | 10/1983 | LeSuer | |
| 4,427,562 | A | 1/1984 | Horodysky et al. | |
| 4,428,182 | A | 1/1984 | Allen et al. | |
| 4,512,903 | A | 4/1985 | Schlicht et al. | |
| 4,617,026 | A | 10/1986 | Shaub et al. | |
| 4,729,769 | A | 3/1988 | Schlicht et al. | |
| 4,789,493 | A | 12/1988 | Horodysky | |
| 4,808,196 | A | 2/1989 | Horodysky | |
| 4,836,829 | A | 6/1989 | Zimmerman et al. | |
| 4,867,752 | A | 9/1989 | Braid et al. | |
| 5,858,029 | A | 1/1999 | Oumar-Mahamat et al. | |
| 5,968,211 | A | 10/1999 | Schilowitz | |
| 6,277,158 | B1 | 8/2001 | McLean | |
| 6,328,771 | B1 | 12/2001 | Moreton | |
| 2002/0095858 | A1 * | 7/2002 | Krull et al. | 44/437 |

FOREIGN PATENT DOCUMENTS

| | | |
|---|---|---|
| EP | 0 482 253 A1 | 4/1992 |
| EP | 0 798 364 A1 | 10/1997 |
| EP | 0 829 527 A1 | 3/1998 |
| EP | 0829527 * | 3/1998 |
| EP | 0 869 163 A1 | 10/1998 |
| WO | WO 01/72930 A2 | 10/2001 |

* cited by examiner

*Primary Examiner*—Cephia D. Toomer
(74) *Attorney, Agent, or Firm*—Dennis H. Rainear; Leah O. Robinson

(57) ABSTRACT

A friction modifier for combustible fuels is provided that is prepared by combining a saturated carboxylic acid and an alkylated amine. Furthermore, there also is an additive concentrate for use in fuels, especially in gasoline for internal combustion engines, comprising (a) a friction modifier comprising of a branched saturated carboxylic acid salt of an alkylated amine, such as n-butylamine isostearate; (b) a detergent package, as well as the combustible fuels containing this additive concentrate. The particular selection of friction modifier (a) enables a stable additive concentrate to be formulated providing a significant benefit in friction loss when incorporated in gasoline used to fuel an internal combustion engine, and hence an improvement in fuel economy. Moreover, the use of the friction modifier (a) in combination with a detergent package permits increased fuel efficiency to be obtained without increasing the incidence of IVD deposits in combustion engines running on a fuel modified with the additive concentrate.

4 Claims, No Drawings

FRICTION MODIFIER ADDITIVES FOR FUEL COMPOSITIONS AND METHODS OF USE THEREOF

BACKGROUND OF THE INVENTION

This invention relates to a friction modifier for use in fuels, particularly in gasolines for internal combustion engines. The present invention further relates to new spark-ignition fuel compositions including such a friction modifier and methods for controlling, i.e., reducing or eliminating, deposits and wear in engines, fuel pumps and injectors while imparting enhanced fuel economy performance.

Over the years considerable work has been devoted to additives for controlling (preventing or reducing) deposit formation in the fuel induction systems of spark-ignition internal combustion engines. In particular, additives that can effectively control fuel injector deposits, intake valve deposits and combustion chamber deposits represent the focal point of considerable research activities in the field and despite these efforts, further improvements are desired.

Conventional port-fuel injection (PFI) engines form a homogeneous pre-mixture of gasoline and air by injecting gasoline into the intake port, while direct injection gasoline (DIG) engines inject gasoline directly into the combustion chamber like a diesel engine so that it becomes possible to form a stratified fuel mixture which contains greater than the stoichiometric amount of fuel in the neighborhood of the spark plug but highly lean in the entire combustion chamber. Due to the formation of such a stratified fuel mixture, combustion with the overall highly lean mixture can be achieved, leading to an improvement in fuel consumption over that of PFI engines, and approaching that of diesel engines.

The major fuel-related deposit problem areas for PFI and DIG engines are injectors, intake valves, and the combustion chamber. Additionally, engine friction between piston and cylinder, the valve train, and the fuel pump result in increasing fuel consumption. In DIG engine technology in particular there is a friction related durability issue with the high-pressure pump (up to 1500 psi pumping capacity), which break down due to the inherently low lubricity of gasolines. There is, therefore, a desire in the petroleum industry to produce a fuel suitable for use in both PFI and DIG engines, that can address the engine deposit and frictional requirements outlined above.

As discussed at some length in U.S. Pat. No. 6,277,158 to McLean, the performance of gasolines and other fuels can be improved through the use of additive technology. For instance, detergents have been used to inhibit the formation of intake system deposits, and thereby improve engine cleanliness and performance. Regulatory mandates have required the introduction of low sulfur fuels, which are known to be less lubricating and raise concerns regarding the durability of fuel pumps and injectors. Sulfur itself is not directly known to be a lubricity modifying agent. However, removal of sulfur by deep hydrotreating is known to also inadvertently remove natural lubricity components of the fuel, such as certain aromatics, carboxylic acids, and esters. Unfortunately, commercial gasoline detergents and dispersants generally show very little friction reducing characteristics until very high concentrations of them are added to the fuel. These high detergent concentrations often reach levels where no-harm effects such as CCD become unacceptable.

It has been suggested that separate friction modifiers can be added to gasoline to increase fuel economy by reducing engine friction. Fuel friction modifiers would also serve to protect high-pressure fuel pumps and injectors such as those found in DIG engines from wear caused by fuel. Worldwide regulations calling for a steep reduction in fuel sulfur levels may exacerbate this wear problem even further. In selecting suitable components for a combined detergent/friction modifier additive package it is important to ensure a balance of detergent and friction modification properties, and so forth. Ideally, the friction modifier should not adversely affect the deposit control function of the detergent. In addition the additive package should not adversely effect on engine performance. For example, the additive package should not promote valve sticking or cause other performance-reducing problems. To be suitable for commercial use, the friction modifier additive also must pass all no-harm testing required for gasoline performance additives. This is often the biggest hurdle for commercial acceptance. The no-harm testing involves 1) compatibility with gasoline and other additives likely to be in gasoline at a range of temperatures, 2) no increase in IVD and CCD, 3) no valve stick at low temperatures, and 4) no corrosion in the fuel system, cylinders, and crankcase. Developing an additive meeting all these criteria is challenging.

Most prior friction modifiers for fuels have been derivatives of natural product (plant and animal derived) fatty acids, with only a few purely synthetic products. For example, WO 01/72930 A2 describes a mechanistic proposal for delivery of a fuel born friction modifier to the upper cylinder wall and into the oil sump resulting in upper cylinder/rings and valves lubrication. The friction modifier is packaged with fuel detergent dispersants such as polyetheramines (PEAs), polyisobutene amines (PIBAs), Mannich bases, and succinimides. Fuel friction modifier prior art identified in the WO '930 reference include U.S. Pat. Nos. 2,252,889, 4,185,594, 4,208,190, 4,204,481, and 4,428,182, which all describe use of fuel modifiers in diesel fuel. Chemistries covered by these patents include fatty acid esters, unsaturated dimerized fatty acids, primary aliphatic amines, fatty acid amides of diethanolamine and long-chain aliphatic monocarboxylic acids. Another specific mentioned patent therein is U.S. Pat. No. 4,427,562, which discloses a lubricant oil and fuel friction modifier made by reacting primary alkoxyalkylamines with carboxylic acids or by aminolysis of the appropriate formate ester, and also U.S. Pat. No. 4,729,769.

U.S. Pat. No. 4,729,769, describes a gasoline carburetor detergent for gasoline compositions derived from reaction products of a $C_6$–$C_{20}$ fatty acid ester, such as coconut oil, and a mono- or di-hydroxy hydrocarbyl amine, such as diethanolamine, as carburetor detergents. The additive in the '769 patent is described as being useful in any gasoline including leaded and those containing methylcyclopentadienyl manganese tricarbonyl (MMT). The fuel described in the '769 patent may contain other necessary additives such as anti-icers, and corrosion inhibitors.

U.S. Pat. No. 5,858,029 describes friction reducing additives for fuels and lubricants involving the reaction products of primary etheramines with hydrocarboxylic acids to give hydroxyamides that exhibit friction reduction in fuels and lubricants. Other prior patents describing friction modifiers include U.S. Pat. No. 4,617,026 (monocarboxylic acid of ester of a trihydric alcohol, glycerol monooleate as fuels and lubricant friction modifier); U.S. Pat. Nos. 4,789,493, 4,808,196, and 4,867,752 (use of fatty acid formamides); U.S. Pat. No. 4,280,916 (use of fatty acid amides); U.S. Pat No. 4,406,803 (use of alkane 1,2-diols in lubricants to improve fuel economy); and U.S. Pat. No. 4,512,903 (use of amides from mono- or polyhydroxy substituted aliphatic monocarboxylic acids and amines). U.S. Pat. No. 6,328,771 discloses fuel compositions containing lubricity enhancing salt compositions made by the reaction of certain carboxylic acids with a component that is comprised of a heterocyclic aromatic amine. EP 0 798 364 discloses diesel fuel additives comprising a salt of a carboxylic acid and an aliphatic amine, or an amide obtained by dehydration-condensation between a carboxylic acid and an aliphatic amine.

EP 0 869 163 A1 describes a method for reducing engine friction by use of ethoxylated amines. In addition, U.S. Pat. No. 4,086,172 (oil soluble hydroxyamines such as "ETHOMEEN 18-12™" formula $C_{18}H_{37}N—(CH_2CH_2OH)_2$ as lubricant antioxidant); U.S. Pat. No. 4,129,508 (reaction products of succinic acid or anhydride and a polyalkylene glycol or monoether, an organic basic metal, and an alkoxylated amine as a demulsifier); U.S. Pat. Nos. 4,231,883; 4,409,000; and 4,836,829, all teach various uses of hydroxyamines in fuels and lubricants.

U.S. Pat. No. 6,277,158 describes the current practice in the supply of gasoline as generally being to pre-mix the fuel additives into a concentrate in a hydrocarbon solvent base, and then to inject the concentrate into gasoline pipelines used to fill tankers prior to delivery to the customer. To facilitate injection of the concentrate into the gasoline, it is important that the concentrate is in the form of a low viscosity, homogeneous liquid.

A friction modifier may be added to the gasoline as the lone additive or in combination with a detergent dispersant package that is fully formulated for fuel compatibility at conditions likely to be experienced by the engine. In addition, a need may exist for a detergent/friction modifier additive concentrate for gasoline that provides all of fuel economy enhancement, deposit control and friction reduction. In addition it should be stable over the temperature range at which the concentrate may feasibly be stored, and which does not adversely affect the performance and properties of the finished gasoline or engine in which the gasoline is used, and in particular, does not lead to increased IVD problems.

SUMMARY OF THE INVENTION

The present invention provides a friction modifier prepared by combining saturated carboxylic acid and alkylated amine. The present invention also relates to a composition of matter useful as an additive concentrate for combustion engine fuels containing the friction modifier and a detergent package. In one embodiment, there is a composition of matter useful as an additive concentrate for combustion engine fuels, containing (a) a friction modifier comprising branched saturated carboxylic acid salt of an alkylated amine, and (b) a detergent package.

As used herein, the term "alkylated" is generic in that it can mean monoalkylated, or polyalkylated (such as "dialkylated"). The term "amine," as used in connection with the friction modifier (a), is generic in that it can mean monoamine, or polyamine (such as "diamine"). In one preferred aspect, the friction modifier (a) comprises branched saturated carboxylic acid salt of a mono- or di-alkylated amine. In another preferred aspect, the friction modifier (a) comprises an alkylamine isostearate. It also will be appreciated that the friction modifier (a) and detergent package (b) are not identical materials.

When incorporated into an engine fuel, the friction modifier (a) is included in an amount effective such that the engine running on the fuel has significantly reduced engine friction loss, which translates into increased fuel economy, without having a deleterious affect on engine deposits. This can be accomplished in this particular case by the use of a saturated acid as the starting material. Unsaturated materials can cause problems since they contribute to deposits in the engine.

In one particular aspect, the present invention provides an additive concentrate for use in combustion engine fuels comprising, by weight based on the total weight of the concentrate:

(a) 0.2 to 50% friction modifier comprising of a branched saturated carboxylic acid salt of a mono- or di-alkylated amine, which preferably is a liquid or can be solubilized at room temperature and pressure;

(b) 40 to 99.8% detergent package mainly comprised of a detergent and carrier mix; and (c) 0 to 80% solvent.

In one example of the invention, the friction modifier is n-butylamine isostearate or a branched saturated isomer thereof, or mixtures thereof. Also, the friction modifier (a) can be ashless or ash-producing, and in a preferred embodiment is ashless.

In one aspect, the particular selection of a branched saturated carboxylic acid salt of an alkylated amine, in combination with a detergent package, enables a stable additive concentrate to be formulated having a friction modifier effective to achieve a significant benefit in friction loss, and hence an improvement in fuel economy, yet without leading to an increase in IVD.

In one preferred embodiment, the friction modifier as defined herein comprises a mixture of different monoamine salts having different respective fatty acid moieties with different length backbones and variable degrees of branching. Such mixtures of friction modifier species can further lower the melting point of that additive ingredient, providing a friction modifying component more prone to be in a liquid. The preferred friction modifier is typically a liquid over at least the temperature range of about −20° C. to about +35° C.

It has been found that the friction modifier comprising a branched saturated carboxylic acid salt of an alkylated amine provides all the benefits explained above, while comparison compounds such as n-butylamine oleate in particular, when used in combination with a detergent, undesirably lead to increases in the incidence of IVD. While not desiring to be bound to a theory, it nonetheless is postulated that provision of a saturated fatty acid moiety in the friction modifier compound in accordance with the present invention helps in not interfering with the desired IVD control mechanisms sought when using fuels modified with the additive concentrate containing the friction modifier and detergent, while imparting the separately desired friction modification functionality.

The provision of structural branching in the polyalkylene backbone of the fatty acid moiety of a branched saturated carboxylic acid salt of an alkylated amine used as the friction modifier in the practice of the present invention has been found important to increase the likelihood that the saturated friction modifier additive compound remains fluid and easily miscible with fuels at normal operating temperatures. However, solubilizing agents, for example hydrocarbon solvents such as alcohols or organic acids, may be included if desired or needed to help solubilize a solid form of a friction modifier, and therefore are not excluded from the scope of the present invention, although they are not an essential requirement.

Further, this invention is also directed to methods of increasing fuel efficiency while controlling deposits in direct injection gasoline engines. In another embodiment, the inventive composition of matter is provided as an aftermarket or "top treat" fuel additive composition.

DETAILED DESCRIPTION OF THE PREFERRED EMBODIMENTS

The present invention is directed in an embodiment to friction modifier prepared by the reaction, mixing or combination of a saturated fatty acid and an alkylated amine. In one exemplary aspect, the friction modifier is prepared by the reaction, mixing or combination of (i) a saturated fatty acid, and (ii) a monoalkylated monoamine, or a dialkylated monoamine, or a combination thereof. In one preferred aspect, the saturated fatty acid used in the preparation of the friction modifier is a branched saturated fatty acid.

When this friction modifier is used in combination with a detergent package for fuels combusted in engines having intake valves, a remarkable performance enhancement effect is provided combining fuel economy improvements without increasing IVD. For instance, saturated and branched carboxylic acid salts of an alkylated monoamine are friction modifiers found by the present investigators to show especially excellent gasoline fuel economy enhancing properties through, for example, 1) the lowering of the boundary friction coefficient of the thin lubricating oil film on the upper cylinder walls of the engine, and 2) the lowering of IVD when used in combination with a detergent or deposit inhibitor to levels lower than those of the deposit inhibitor alone. They also may exhibit superior demulse capabilities.

Friction Modifier

The friction modifier used in the present invention, in a preferred embodiment, comprises a saturated carboxylic acid salt of a monoalkylated or dialkylated amine. In a more preferred embodiment, branching is included in the backbone of the saturated carboxylic acid to enhance compatibility with fuels at low ambient temperatures.

A non-limiting structural representation of a suitable branched saturated carboxylic acid salt of an alkylated amine is the following general structural formula I:

(I)

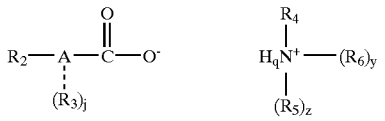

where $R_2$ and $R_3$ each independently represents an alkyl group, preferably a $C_1$–$C_6$ alkyl group, and more preferably methyl; j is 1 to 20, preferably 1 to 5; A represents —$(CH_2)_x$— where x is 4 to 20; with the provisos that each $R_3$ is substituted for a hydrogen of a backbone carbon atom in A and no more than two $R_3$ groups are bonded to any given one backbone carbon atom in A; $R_4$, $R_5$ and $R_6$ each independently represents a hydrocarbyl group, such as an alkyl group, or a hydrogen atom; and q is 1, 2 or 3, and z and y each independently is 0 or 1, with the proviso that q is 3 where z and y each is 0, q is 2 when one of z or y is 1 and the other is 0, and q is 1 when z and y each is 1.

In one further embodiment, $R_4$ and $R_5$ in structure I each independently represent an aliphatic $C_1$–$C_8$ alkyl group, which can be straight, branched, nonsubstituted, or substituted, and with the proviso that any branching or substitution(s) present does not undermine the friction modifying functionality of the ingredient or render it incompatible with the modified fuel composition. In one particular embodiment, $R_4$ and $R_5$ each independently represents a nonhydroxylated, aliphatic $C_1$–$C_8$ alkyl group. In a further aspect, $R_2$ and $R_3$ in structure I each can independently represent an aliphatic $C_1$–$C_6$ alkyl group, which can be straight, branched, nonsubstituted, or substituted, and with the proviso that any branching or substitution(s) present does not undermine the friction modifying functionality of the ingredient or render it incompatible with the modified fuel composition.

The branched saturated carboxylic acid salt of an alkylated amine used as friction modifiers in this invention can be made, for example, by mixing (i) a branched saturated carboxylic acid, or mixtures thereof, with (ii) a mono- and/or di-alkylated monoamine, and/or a mono- and/or di-alkylated polyamine, at an approximately 1:1 molar ratio, and with stirring at temperatures ranging from 25° C. to 75° C., until there is no further temperature change.

Mixtures of friction modifiers as defined herein having different back bone lengths and variable degrees of branching can be advantageously used as the friction modifier component (a). Such mixtures can further lower the melting point of the additive ingredient, providing a friction modifying component more prone to be in a liquid state.

Also, the alkylated amine moiety of the friction modifier compound of structure I can be, for example, a monoalkyl monoamine moiety such as an n-butyl amine moiety, or, alternatively, a dialkyl monoamine moiety such as a di-n-butyl amine moiety.

As an exemplary friction modifier component (a), there is n-butylamine isostearate, which has the general formula: $(CH_3)_2CH(CH_2)_{14}C(O)O^{-+}NH_3C_4H_9$.

N-butylamine isostearate can be used as the friction modifier as well as saturated branched isomers thereof. An exemplary non-limiting structural representation of n-butylamine isostearate is the following structure II:

(II)

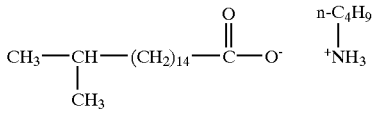

The n-butylamine isostearate, as described above, can be made by mixing n-butylamine and isostearic acid at a 1:1 molar ratio, and stirring at temperatures ranging from 25° C. to 75° C. until there is no further temperature change.

The treat level of the friction modifier in the finished gasoline generally will be an amount providing the improved performance effects, such an in terms of improving fuel efficiency, and so forth, as described herein. For example, a treat level of at least about 5 PTB (pounds per thousand barrels), and more preferably at least about 50 PTB, of the friction modifier can be used for gasolines.

The friction modifier component (a) can be used as a relatively pure form of branched saturated carboxylic acid salts of an alkylated amine, or optionally in the co-presence of other branched carboxylic acid salts of alkylated amines having an iodine number less than 10, as long as the latter do not adversely affect the desired performance characteristics of this additive, as identified herein.

Gasoline Performance Additive (GPA) Package

A traditional GPA package is generally comprised of a detergent package that mainly comprises a detergent and a carrier mix whose primary purpose is to keep the components parts of the engine free of deposits. Other components present in the GPA package typically include a corrosion inhibitor, a demulsifying agent, antioxidants and solvents. In some cases a marker is added to the GPA package for identification. Thus, the detergent package typically is introduced to the fuel additive concentrate as part of a GPA package, although this is not required.

Detergent (Deposit Inhibitor) Package

The detergent or deposit inhibitor used in the detergent package component of the additive concentrate described herein may include any suitable commercially available detergent or deposit inhibitor available for this function. Deposit inhibitors for gasoline, usually referred to as detergents or dispersants, are well known and a variety of compounds can be used. Examples include Mannich bases, polyalkylene amines, and polyalkylene succinimides where the polyalkylene group typically has a number average molecular weight of from 600 to 2000, preferably from 800 to 1400, and polyether amines. A preferred detergent for the additive concentrate of the present invention is a Mannich base detergent.

The Mannich base detergents suitable for use in the present invention include the reaction products of a high molecular weight alkyl-substituted hydroxyaromatic compound, aldehydes and amines. The alkyl-substituted hydroxyaromatic compound, aldehydes and amines used in making the Mannich reaction products of the present invention may be any such compounds known and applied in the art.

Suitable Mannich detergents for use in the present invention include those detergents taught in U.S. Pat. Nos. 4,231,759; 5,514,190; 5,634,951; 5,697,988; 5,725,612; and 5,876,468, the disclosures of which are incorporated herein by reference. Suitable Mannich base detergents also include, for example, HiTEC® 4995 and HiTEC® 6410 Detergents and are available from the Ethyl Corporation, Richmond, Va., U.S.A.

Carrier

In a preferred embodiment, the detergents are preferably used with a carrier or induction aid. This carrier typically will be a carrier fluid. Such carriers can be of various types, such as, for example, liquid poly-α-olefin oligomers, mineral oils, liquid poly(oxyalkylene) compounds, polyalkenes, and similar liquid carriers. Mixtures of two or more such carriers can also be employed.

Optional Solvent

Among other things, the kinematic viscosity of the additive concentrate can be adjusted (reduced) by solvent addition, if desired or needed. To achieve this, a solvent can be added to the concentrate, such as an aromatic hydrocarbon solvent or an alcohol. Examples include toluene, xylene, tetrahydrofuran, isopropanol isobutylcarbinol, n-butanol, and petroleum hydrocarbon solvents such as solvent naphtha, and the like.

Fuel Compositions

The fuel compositions of the present invention may contain supplemental additives in addition to deposit control additives described above. Said supplemental additives include dispersants/detergents, antioxidants, carrier fluids, metal deactivators, dyes, markers, corrosion inhibitors, biocides, antistatic additives, drag reducing agents, demulsifiers, emulsifiers, dehazers, anti-icing additives, antiknock additives, anti-valve-seat recession additives, lubricity additives, surfactants and combustion improvers.

In another aspect, the present invention provides a fuel composition comprising combustible fuel and from 50 to 2500 ppm by weight of an additive combination comprising components (a), (b), and optionally a solvent (c), as described herein.

The combustible fuel used in the fuel composition of this invention is generally a petroleum hydrocarbon useful as a fuel, e.g., gasoline, for internal combustion engines. Such fuels typically comprise mixtures of hydrocarbons of various types, including straight and branched chain paraffins, olefins, aromatics and naphthenic hydrocarbons, and other liquid hydrocarbonaceous materials suitable for spark ignition gasoline engines.

These compositions are provided in a number of grades, such as unleaded and leaded gasoline, and are typically derived from petroleum crude oil by conventional refining and blending processes such as straight run distillation, thermal cracking, hydrocracking, catalytic cracking and various reforming processes. Gasoline may be defined as a mixture of liquid hydrocarbons or hydrocarbon-oxygenates having an initial boiling point in the range of about 20 to 60° C. and a final boiling point in the range of about 150 to 230° C., as determined by the ASTM D86 distillation method. The gasoline may contain other combustibles such as alcohol, for example methanol or ethanol.

The combustible fuels used in formulating the fuel compositions of the present invention preferably include any combustible fuels suitable for use in the operation of direct injection gasoline engines such as leaded or unleaded motor gasolines, and so-called reformulated gasolines which typically contain both hydrocarbons of the gasoline boiling range and fuel-soluble oxygenated blending agents ("oxygenates"), such as alcohols, ethers and other suitable oxygen-containing organic compounds. Preferably, the fuel is a mixture of hydrocarbons boiling in the gasoline boiling range. This fuel may consist of straight chain or branch chain paraffins, cycloparaffins, olefins, aromatic hydrocarbons or any mixture of these. The gasoline can be derived from straight run naptha, polymer gasoline, natural gasoline or from catalytically reformed stocks boiling in the range from about 80° to about 450° F. The octane level of the gasoline is not critical and any conventional gasoline may be employed in the practice of this invention.

Oxygenates suitable for use in the present invention include methanol, ethanol, isopropanol, t-butanol, mixed $C_1$ to $C_5$ alcohols, methyl tertiary butyl ether, tertiary amyl methyl ether, ethyl tertiary butyl ether and mixed ethers. Oxygenates, when used, will normally be present in the base fuel in an amount below about 30% by volume, and preferably in an amount that provides an oxygen content in the overall fuel in the range of about 0.5 to about 5 percent by volume.

The additives used in formulating the preferred fuels of the present invention can be blended into the base fuel individually or in various sub-combinations.

The friction modifier additive according to the present invention can be used generally in internal combustion engines that burn liquid fuel, especially spark-ignited gasoline engines that are carbureted, port-fuel injected (PFI), and direct injected gasoline (DIG). A preferred embodiment of the present invention comprises a method for increasing fuel efficiency while controlling engine deposit and fuel systems wear. This is achieved by introducing into the engine fuel composition a) a spark-ignition fuel and b) a deposit inhibitor package/friction modifier additive as described herein which has been dispersed therein.

EXAMPLES

The practice and advantages of this invention are demonstrated by the following examples, which are presented for purposes of illustration and not limitation.

Test Samples Preparation

For purposes of the following examples, a number of different friction modifiers were tested either as a 5% solution in a 5W30 GF-3 test oil for boundary friction measurements, or in combination with the detergent HiTEC® 6421 for Sequence VI-B fuel economy engine tests and IVD measurements. HiTEC® 6421 Gasoline Performance Additive (GPA) is commercially available from Ethyl Corporation, Richmond, Va., U.S.A. For the Sequence VI-B engine fuel economy testing described in the examples below, the friction modifier/GPA combinations were formulated to contain (a) 50 PTB friction modifier, and (b) 80.9 PTB of HiTEC® 6421 GPA as the detergent source.

An example of a friction modifier (FM) additive representing the present invention is n-butylamine isostearate (FM-1). As a comparison, n-butylamine oleate (FM-2) instead was used in the same wt % proportion in place of n-butylamine isostearate to demonstrate the IVD control superiority of the invention FM-1. Another friction modifier prepared for testing in an example below, and representing the present invention, contained friction modifier FM-3 made by reacting n-butyl amine and a mixture of branched saturated fatty acids. The mixture of branched saturated fatty acids was obtained from Arizona Chemical under the generic product name Century 1101. A reaction product of coconut oil and diethanolamine (FM-4) made according to the method described in U.S. Pat. No. 4,729,769, was also used as a comparative friction modifier in several of the examples below.

Example 1

Boundary friction coefficients were measured for the various friction modifier additives identified below in Table 1, which were prepared as indicated under the Test Samples Preparation section above, and a control (no additive), using a PCS Instruments High Frequency Reciprocating Rig. A 4N load was applied between a 6 mm diameter ANSI 52100 steel ball and an ANSI 52100 steel flat. The ball was oscillated over a 1 mm path at a frequency of 20 Hz. The oil used was SAE Grade 5W30 of GF-3 quality without friction modifier. Friction coefficients were measured in triplicate at 100 and 130° C., and averages of these values are presented in Table 1.

TABLE 1

| Additive | Friction Coefficient (100° C.) | Friction Coefficient (130° C.) |
|---|---|---|
| None | 0.122 | 0.128 |
| n-Butylamine Isostearate (FM-1) | 0.095 | 0.090 |
| n-Butylamine Oleate (FM-2) | 0.090 | 0.070 |
| Product of coconut oil and diethanolamine (FM-4) | 0.106 | 0.107 |

The friction coefficient values of oil samples containing n-butylamine isostearate (FM-1) were significantly superior to the control containing no additive, and the comparison sample containing the FM-4, a reaction product of coconut oil and diethanolamine. The friction coefficient values of oil samples containing n-butylamine isostearate (FM-1) also were comparable with the friction coefficient values of the separate test sample adding n-butylamine oleate (FM-2).

Example 2

Sequence VI-B fuel economy increase (FEI) values were determined for additive formulations containing 80.9 PTB of the Mannich Detergent Package A (i.e., HiTEC® 6421 GPA) at a regular treat level top treated with 50 PTB friction modifier n-butylamine isostearate (FM-1), and, separately, with a friction modifier FM-4, made by reacting coconut oil and diethanolamine. A third friction modifier prepared for testing as above contained the friction modifier FM-3 made by reacting n-butyl amine and a mixture of branched saturated fatty acids obtained from Arizona Chemical under the generic product name Century 1101. The mixture of n-butyl amine and fatty acids was mixed in a 1:1 molar ratio with stirring at temperatures ranging from 25° C. to 75° C. until there is no further temperature change.

To obtain the fuel economy increase (FEI) data for each friction modifier additive described in Table 2 below, a Sequence VI-B engine was first calibrated with a standard baseline calibration oil (BC oil). The oil used to test the friction modifier additives was an SAE Grade 5W30 oil of GF-3 quality with HiTEC® 7133 lubricant friction modifier, which was used so that the results obtained would reflect real world performance of the candidate gasoline additives in commercial motor oils. The test was run according to standard Sequence VI-B procedure. The engine was run on additive free base fuel for 80 hours to age the oil, and then the brake specific fuel consumption (BSFC) measured for all five Sequence VI-B stages. Then the fuel was switched to that containing the detergent/friction modifier additive formulation, and the engine allowed to equilibrate before a second BSFC was measured. The fuel was switched back to base fuel, the engine allowed to equilibrate, and a third BSFC was measured. Finally, the friction modifier was injected into the sump in an amount to simulate long-term accumulation in the oil, and a final BSFC measured. From this data instantaneous and long-term fuel economy increase (FEI) was calculated for each respective additive. Example values are shown in the Table 2 below.

TABLE 2

| Additive Formulation | Instantaneous FEI (%) | Long Term FEI (%) |
|---|---|---|
| Mannich Detergent Package (A) + FM-1 | 1.98 | 2.20 |
| Mannich Detergent Package (A) + FM-3 | 1.99 | 2.45 |
| Mannich Detergent Package (A) + FM-4 | 1.73 | 2.05 |

These results clearly demonstrate the significant improvements obtained in fuel economy with use of the additives (FM-1 and FM-3) according to the invention versus the comparison additive (i.e., FM-4). An instantaneous FEI value of 1.99% and a long-term FEI value of 2.45% were achieved using the FM-3 friction modifier, which were even higher values than the respective results for FM-1.

Example 3

IVD measurements were carried out on a Ford 2.3 L engine according to a modified version of the ASTM D-6201 procedures to compare the FM-1 and FM-2 additives. These IVD measurements differed from ASTM D-6021 only in that the valves were used only once with each test and then were replaced with new ones before any subsequent test; otherwise the protocols were the same. IVD levels of fuels containing 80.9 PTB of the Mannich detergent (and carrier fluid) supplied as HiTEC® 6421 GPA, with 50 PTB friction modifier n-butylamine isostearate (FM-1), and, separately, with 50 PTB n-butylamine oleate (FM-2), were measured. The results are summarized in Table 3.

TABLE 3

| Additive Formulation | Intake Valve Deposit (IVD) in mg |
|---|---|
| Mannich Detergent (A) | 209.8 |
| (A) + FM-1 | 176.2 |
| (A) + FM-2 | 285.3 |

The results are also illustrated in Table 3, which shows the significantly better IVD control and reduction achieved with the fuel composition containing the n-butylamine isostearate friction modifier (FM-1) and detergent combination, as compared to the comparison fuel composition containing the n-butylamine oleate additive (FM-2) combined with the same type of detergent.

The data indicate that both n-butylamine isostearate and n-butylamine oleate function as friction modifiers for gasoline, but that the use of fuel additives containing both a detergent and the n-butylamine isostearate results in decreased occurrence of IVD, while the use of fuel additives containing the detergent in combination with n-butylamine oleate results in an undesirable increase in the occurrence of IVD.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as a Mannich condensation reaction) or in forming a desired composition (such as an additive concentrate or additized fuel blend). It will also be recognized that the additive components can be added or blended into or with the base fuels individually per se and/or as components used in forming preformed additive combinations and/or sub-combinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations is thus wholly immaterial for an accurate understanding and appreciation of this disclosure and the claims thereof.

As used herein the term "fuel-soluble" or "gasoline-soluble" means that the substance under discussion should be sufficiently soluble at 20° C. in the base fuel selected for use to reach at least the minimum concentration required to enable the substance to serve its intended function. Preferably, the substance will have a substantially greater solubility in the base fuel than this. However, the substance need not dissolve in the base fuel in all proportions.

At numerous places throughout this specification, reference has been made to a number of U.S. Patents. All such cited documents are expressly incorporated in full into this disclosure as if fully set forth herein.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A composition of matter useful as an additive concentrate for combustion engine fuels, comprising (i) n-butylamine isostearate, and (ii) a detergent package comprising detergent and carrier fluid.

2. A fuel additive concentrate comprising:

(a) 0.2 to 50 wt % of n-butyl amine isostearate;

(b) 40 to 99.8 wt % detergent package comprising detergent and carrier; and (c) 0 to 80 wt % of solvent.

3. A fuel composition comprising:

a combustible fuel; and from 50 to 2500 ppm by weight based on the weight of fuel of an additive combination comprising:

(a) 0.2 to 50 wt % of n-butyl amine isostearate;

(b) 40 to 99.8 wt % of a detergent package comprising detergent and carrier; and (c) 0 to 80 wt % of solvent.

4. A method for increasing the fuel efficiency in a gasoline combustion engine, said method comprising combusting in the engine a gasoline fuel comprising a major amount of a fuel boiling in the gasoline boiling range, and a minor amount of n-butylamine isostearate.

* * * * *